US006659923B2

(12) United States Patent
Teuscher

(10) Patent No.: US 6,659,923 B2
(45) Date of Patent: Dec. 9, 2003

(54) EXERCISE BENCH WITH LINEARLY ADJUSTABLE CARRIAGE AND CONVENIENT BACK AND SEAT ADJUSTMENTS

(75) Inventor: Phillip M. Teuscher, Kansas City, MO (US)

(73) Assignee: Pro Star Sports, Incorporated, Kansas City, MO (US)

( * ) Notice: Subject to any disclaimer, the term of this patent is extended or adjusted under 35 U.S.C. 154(b) by 123 days.

(21) Appl. No.: 09/951,051

(22) Filed: Sep. 12, 2001

(65) Prior Publication Data

US 2003/0050157 A1 Mar. 13, 2003

(51) Int. Cl.[7] ..... A63B 26/00
(52) U.S. Cl. ..... 482/142; 482/148
(58) Field of Search ..... 482/142, 148

(56) References Cited

U.S. PATENT DOCUMENTS

| | | | | | |
|---|---|---|---|---|---|
| 194,477 | A | | 8/1877 | Smith et al | |
| 4,546,957 | A | | 10/1985 | Jalil et al. | |
| 4,566,691 | A | | 1/1986 | Mahnke | |
| 4,635,934 | A | | 1/1987 | Roethke | |
| 4,641,837 | A | | 2/1987 | Ruth | |
| 4,653,751 | A | | 3/1987 | Green | |
| 4,729,561 | A | | 3/1988 | Desjardins | |
| 4,746,114 | A | * | 5/1988 | Grider | 272/123 |
| 4,749,190 | A | | 6/1988 | Jennings | |
| 4,765,616 | A | | 8/1988 | Wolff | |
| 4,871,166 | A | | 10/1989 | Sterba et al. | |
| 4,900,013 | A | * | 2/1990 | Rodgers | 272/70 |
| 5,069,447 | A | | 12/1991 | Snyderman et al. | |
| 5,072,929 | A | * | 12/1991 | Peterson et al. | 272/72 |
| 5,190,513 | A | | 3/1993 | Habing et al. | |
| D336,917 | S | | 6/1993 | Iwanaga | |
| 5,232,426 | A | | 8/1993 | Van Straaten | |
| 5,637,059 | A | | 6/1997 | Dalebout | |
| 5,649,886 | A | | 7/1997 | Danylieko | |
| 5,665,038 | A | | 9/1997 | Miller | |
| 5,725,460 | A | | 3/1998 | Marsh | |
| D406,290 | S | | 3/1999 | McBride | |
| 5,993,363 | A | * | 11/1999 | Chen | 482/138 |
| 6,030,324 | A | | 2/2000 | McBride | |
| 6,106,445 | A | * | 8/2000 | Lay | 482/142 |
| 6,238,322 | B1 | * | 5/2001 | Hsu | 482/96 |
| 6,361,479 | B1 | * | 3/2002 | Hildebrandt et al. | 482/72 |

* cited by examiner

*Primary Examiner*—Nicholas D. Lucchesi
*Assistant Examiner*—Lori Amerson
(74) *Attorney, Agent, or Firm*—Shook, Hardy & Bacon L.L.P.

(57) ABSTRACT

An exercise bench includes a seat and a back which are independently adjustable angularly and are mounted on a carriage that rolls along rails of a stationary base. The linear position of the bench can be adjusted without the need to move any part of the frame along the surface on which the base rests. The adjustments for the angular positions of the seat and base and for the linear position are easily accessible and operable by a user sitting on the seat. The seat has an independent angular adjustment but can be maintained locked to the back so that pivotal adjustment of the back to different inclinations does not affect the angular position of the seat relative to the back.

20 Claims, 2 Drawing Sheets

FIG 1
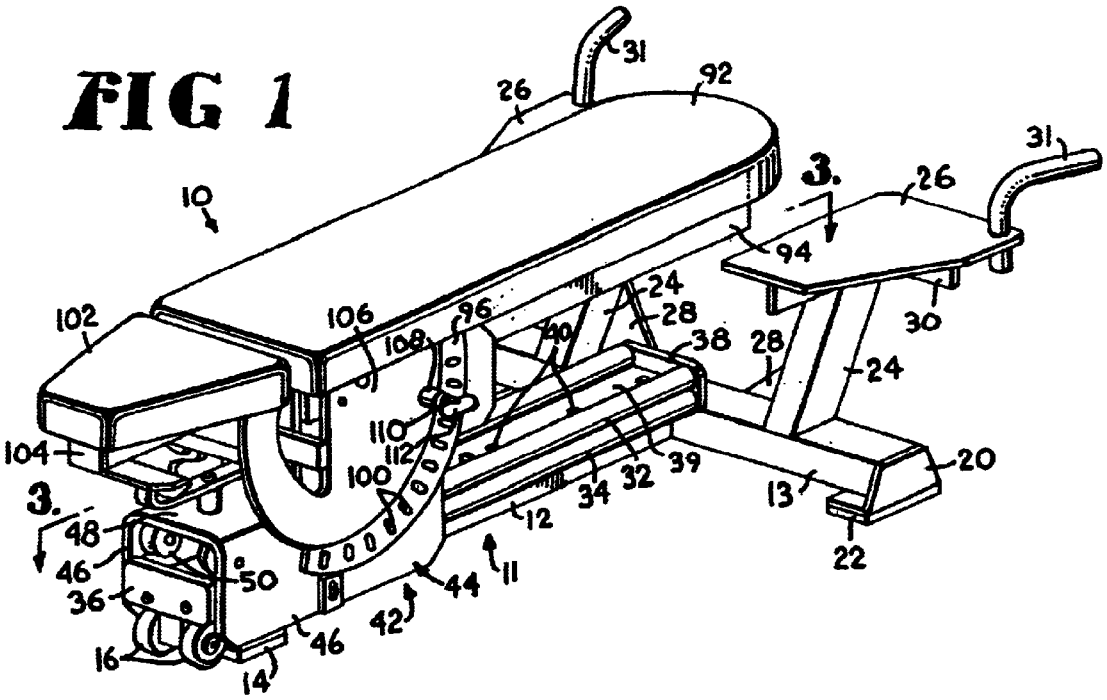
FIG. 5.
FIG. 2.
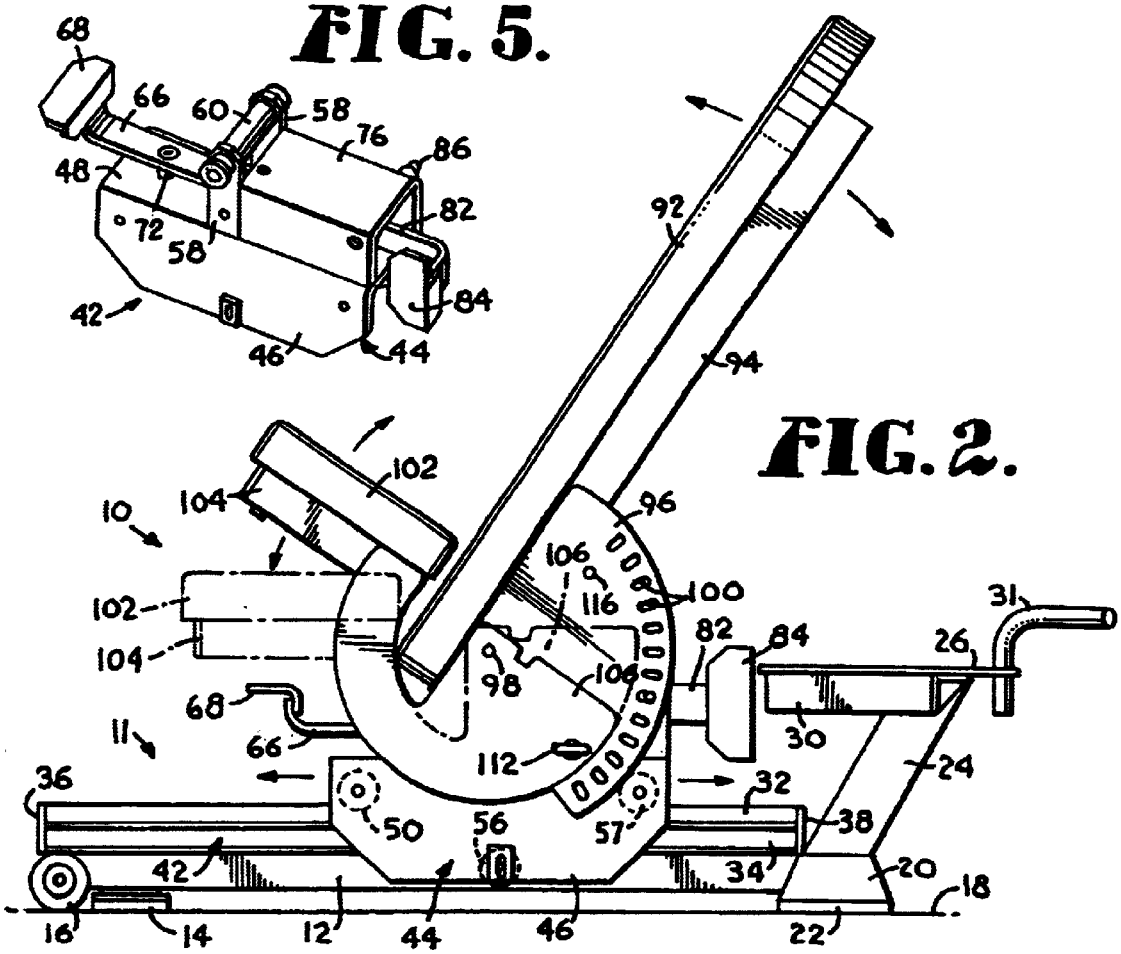

FIG. 3.
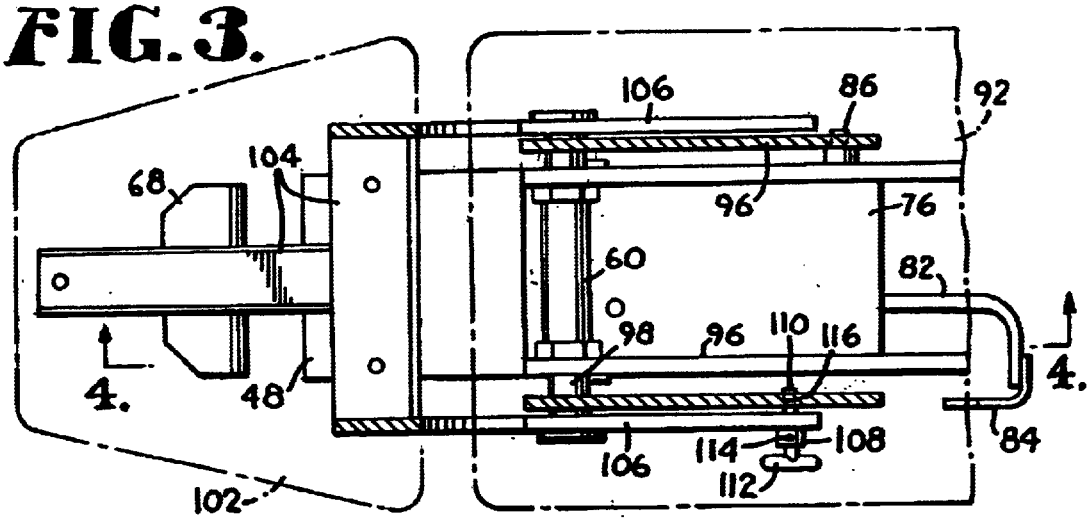
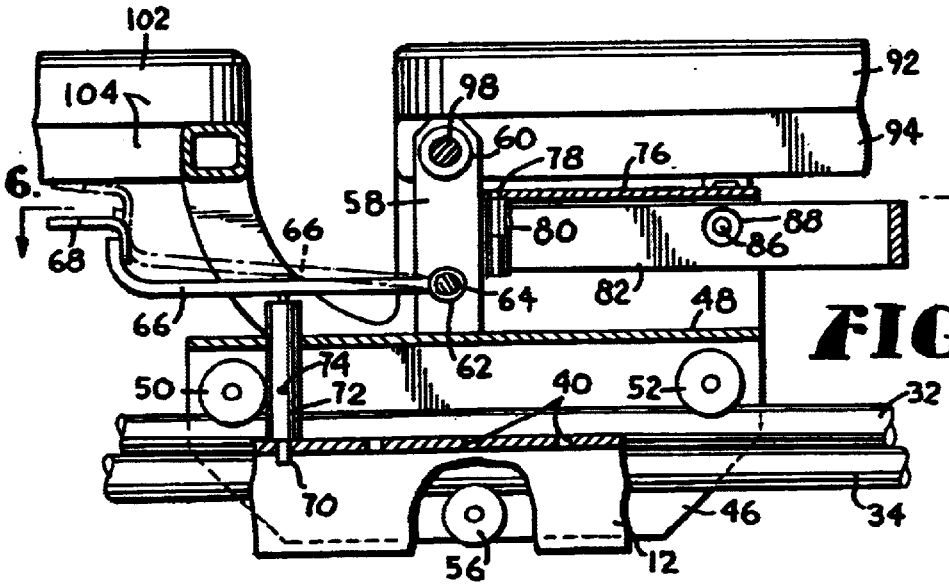
FIG. 4.
FIG. 6.
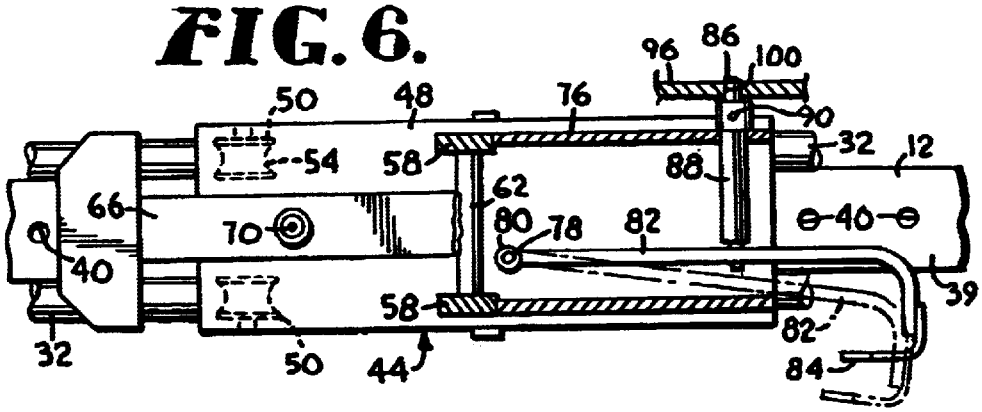

EXERCISE BENCH WITH LINEARLY ADJUSTABLE CARRIAGE AND CONVENIENT BACK AND SEAT ADJUSTMENTS

FIELD OF THE INVENTION

This invention relates generally to exercise benches of the type used during exercises such as lifting handheld or rack mounted weights. More particularly, the invention is directed to an exercise bench in which the seat and back are conveniently adjustable angularly and are mounted on a carriage that is linearly adjustable along a stationary support base.

BACKGROUND OF THE INVENTION

Exercise benches for weight training and other exercises have been constructed in a manner allowing linear adjustment of the bench so that different types of exercises are accommodated. However, two different frames have been used in the construction of these benches in order to allow the location of the bench to be adjusted linearly. Typically, this type of two-part frame construction has made use of two telescoping frames which has led to a variety of drawbacks and complications. Separate frames that interfit telescopically creates a structure that is inherently somewhat weak. The frames can accidentally slip relative to one another rotatively and otherwise which can cause the locking mechanism to disengage. The frame structure can then collapse and possibly result in personal injury. Linear adjustment of the bench requires at least one of the frame sections to move along the underlying surface. If the surface is rough or uneven, as in the case of sand, shag carpets, gravel and grass surfaces, adjustment of the frames is difficult at best and often impossible. Units that have two frame sections are also unstable on rough or uneven surfaces. A two frame construction is unduly heavy because both of the frame sections must be heavy duty structures. High costs are also associated with this relatively complicated two-part construction.

The backs and seats of existing exercise benches are commonly adjustable in order to provide various inclined positions. However, the adjustments are difficult to carry out and require the user to vacate the seat and stand to one side in order to reach the adjustment mechanism and make the necessary adjustment. This inconvenience detracts significantly from the appeal of the equipment and from its ease of use.

SUMMARY OF THE INVENTION

The present invention is directed to an exercise bench that is improved in a number of respects compared to what has been available in the past. In particular, the invention is characterized by a bench that is mounted on a carriage having a rolling connection with a sturdy base frame. By virtue of this construction, the bench can be adjusted linearly without the need to roll or otherwise move any parts along the underlying support surface. This allows the equipment to readily accommodate surfaces such as carpets, rugs, grass, sand, gravel and other rough or uneven surfaces.

Another important feature of the invention is that it allows the user to make all desired adjustments while remaining seated on the seat portion of the bench. The linear adjustment for the bench and the angular adjustments for the seat and back can be easily reached from a sitting position on the seat, so the bench can be adjusted more conveniently than in the case of the prior art equipment that requires the user to stand and reach the adjustments from one side of the device.

The invention is further characterized by a unique construction that enables the seat to be latched in a selected angular position such as 90° relative to the back and to maintain that relative angular position as the back is adjusted to different inclined orientations. The seat can also be selectively released so that both it and the back can be adjusted to a prone orientation allowing the user to assume a flat horizontal position on the bench when the need arises.

It is also a significant feature of the invention that the seat and back pivot on a common axis to avoid creating an unduly wide gap between them when they are in their prone positions.

Among the other features and characterizing aspects of the invention are its heavy duty yet simple construction, its light weight, its low cost, the ease of making the various adjustments that are provided, its ability to be easily transported between different exercise stations and other locations, and its ability to function reliably even after prolonged use and heavy exercise applications.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a perspective view of an exercise bench constructed according to a preferred embodiment of the present invention, with the seat and back adjusted to accommodate a user lying in a prone position on the bench;

FIG. 2 is a side elevational view of the exercise bench shown in FIG. 1, but with the seat and back adjusted to accommodate a user sitting in an inclined position, with the arrows and broken line position of the seat indicating the directions and manners in which the components of the bench can be adjusted both linearly and angularly;

FIG. 3 is a fragmentary sectional view on an enlarged scale taken generally along line 3—3 of FIG. 1 in the direction of the arrows;

FIG. 4 is a fragmentary sectional view on an enlarged scale taken generally along line 4—4 of FIG. 3 in the direction of the arrows, with the broken lines indicating the release position of a lever used for the linear adjustment feature of the invention;

FIG. 5 is a perspective view of the carriage which is mounted on the base for adjustable movement and on which the bench components are mounted; and FIG. 6 is a fragmentary sectional view taken generally along line 6—6 of FIG. 4 in the direction of the arrows, with the broken lines indicating the release position of a lever used to make angular adjustments of the back portion of the bench.

DETAILED DESCRIPTION OF THE INVENTION

Referring now to the drawings in more detail and initially to FIGS. 1 and 2 in particular, numeral 10 generally designates an exercise bench which is constructed in accordance with a preferred embodiment of the present invention and which may be used to perform various exercises, particularly weight training exercises such as the lifting of conventional handheld and rack mounted weights (not shown). The exercise bench 10 includes a rigid base 11 having a main horizontal beam 12 extending from the front of the unit to the back of the unit. At its back end, the beam 10 connects with a structural cross member which provides a pair of arms 13 extending on opposite sides of the beam 10. The front end portion of the beam 10 is provided with a padded foot 14 and with a pair of wheels 16 which are rotatably mounted to the beam. The wheels allow the bench 10 to be easily moved between different exercise stations by lifting of the back end of the base and rolling the unit along the underlying support surface 18 (FIG. 2) using the wheels 16. The outer ends of the arms 13 are provided with end plates 20 and with padded feet 22. The feet 14 and 22 accommodate stable contact of the base 11 with the support surface 18.

The support surface 18 may take a variety of forms, including smooth surfaces such as finished flooring for a poured concrete surface. The surface 18 may also be a rough or uneven surface such as gravel, sand, shag carpet, grass or bumpy or uneven dirt. The center beam 12 and the cross beam which forms the arms 13 of the base may be constructed of rectangular metal tubing or any other material having the necessary strength. The base 11 is in a stationary position on the surface 18 (except when it is being moved between different locations normally using the wheels 16), so the bench 10 of the present invention can be used on rough or uneven surfaces as well as on smooth and flat surfaces.

A spotter station is provided at the rear of the base 11. A pair of inclined posts 24 extend upwardly from the arms 13 and carry horizontal spotter platforms 26 at their upper ends. The connections between the posts 24 and the arms 13 are reinforced by gusset plates 28. Reinforcing members 30 reinforce and strengthen the connections between the upper ends of the posts 24 and the platforms 26. Each platform 26 is provided with a generally L-shaped handle 31 which is useful in lifting of the back end of the base 11 in order to roll the unit along the surface 18 to a different exercise station or another location.

The base 11 further includes a rail structure which is provided by a pair of upper rails 32 and a pair of lower rails 34 that immediately underlie the upper rails 32. The rails 32 and 34 are located in pairs on opposite sides of the central beam 12 and extend from the front of the base 11 to the back of the base. The rails 32 and 34 are welded or otherwise suitably secured to the opposite sides of the beam 12. A front end plate 36 is secured to the front ends of the rails 32 and 34. Another end plate 38 is suitably secured to the back end of the beam 12 and the rails 32 and 34 at the back end portion of the base 11. The rails 32 and 34 are preferably tubular metal members although other shapes and constructions are possible.

The beam 12 has an upper surface 39 which is horizontal and is located between the rails 32 and 34 on the opposite sides of the base 11. The upper surface 39 of the beam is provided with a plurality of spaced apart openings 40 (FIGS. 1 and 4) which extend along the length of the beam 12 from front to back. The openings 40 may be provided in any desired number and may be spaced part from one another equidistantly or in any other desired arrangement.

A carriage which is generally identified by numeral 42 is mounted on the base 11 for linear movement along its length dimension. The carriage 42 has a main body 44 which takes the form of an inverted U that includes a pair of parallel opposite side plates 46 connected by a horizontal top plate 48. Each of the side plates 46 is provided with a pair of upper rollers, including a front roller 50 and a back roller 52. The rollers 50 are located near the front edge portion of the body 44 adjacent to the inside surfaces of the side plates 46. The back rollers 52 are similarly mounted on the inside surfaces of the plates 46 adjacent to the back end of the body 44. The rollers 50 and 52 are mounted for rotation on the carriage 42 about horizontal axes. As best shown in FIG. 6, the rollers 50 and 52 have cup shaped peripheries 54 curved to mate with the curvature of the top rails 32. The rollers 50 and 52 are located and arranged so that they are applicable to the top surfaces of the upper rails 32 in order to accommodate rolling movement of the carriage 42 along the rails.

The carriage 42 is equipped with a pair of lower rollers 56 (FIGS. 2 and 4) which are mounted on the inside surfaces of the side plates 46 of body 44. The lower rollers 56 are located near the bottom edges of plates 46 midway along their lengths and have cup shaped peripheries similar to the cup shaped peripheries 54 of rollers 50. The rollers 56 are mounted to rotate about a common horizontal axis and are located and arranged to roll against the lower sides of the bottom rails 34. The rolling contact of the rollers 50, 52 and 56 against the rails 32 and 34 provides for easy adjustment of the carriage 42 along the length of the base 11. At the same time, the engagement of the rollers against the top and bottom sides of the rails provides stability, which is enhanced by the close fit of the cup shaped peripheries of the wheels against the curved surfaces of the rails 32 and 34.

The carriage 42 has a pair of upstanding ears 58 which project upwardly from the top plate 48 adjacent to the two side plates 46 near the center of the carriage body 44. A horizontal sleeve 60 is secured to extend between the upper end portions of the ears 58. As best shown in FIGS. 4 and 6, a horizontal sleeve 62 extends between the ears 58 near their lower ends and is able to turn on a horizontal axis provided by a pin 64 (FIG. 4) which extends between the ears 58. A lever 66 is secured at one end to the sleeve 62 and is provided at its forward end with a handle 68. A vertical pin 70 extends downwardly from a central portion of the lever 66 through a sleeve 72. A spring diagrammatically indicated at 74 acts against the pin 72 to continuously urge the lever 66 and pin 70 downwardly toward the solid line position of FIG. 4. In this position, the tip of the pin 70 extends through an aligned one of the openings 40, thereby releaseably locking the carriage 42 to the base 11 in a stationary position of the carriage. The pin 70 can be withdrawn from the opening 40 by pulling upwardly on the handle 68 to move the lever 66 to the broken line position shown in FIG. 4. This pulls the pin 70 upwardly and out of the opening 40.

The carriage 42 includes an inverted U-shaped bracket 76 which is mounted on the top plate 48 behind and adjacent to the ears 58. As best shown in FIG. 4, a vertical pin 78 is secured to the top of the bracket 76 at the upper end of the pin. A sleeve 80 is mounted on the pin 78 to rotate about its vertical axis. A lever 82 is connected at one end to the sleeve and extends out of the bracket 76 at its rearward end which is provided with a handle 84 (see FIGS. 5 and 6 in particular). A horizontal pin 86 connects at one end with the center area of the lever 82 and extends through a sleeve 88 located on one of the side plates of bracket 76. A spring shown diagrammatically at 90 in FIG. 6 acts against the pin 86 in a manner to continuously urge the lever 82 and pin 86 toward the position shown in solid lines in FIG. 6. In this position, the tip of the pin 86 projects outwardly beyond the end of the sleeve 88 to perform a latching function that will be described more fully.

The pin 86 can be withdrawn by pulling the handle 84 in a direction to mover lever 82 to the broken line position shown in FIG. 6. This retracts the pin 86 from its fully extended position and effects unlatching of the pin.

The bench portion of the exercise bench 10 includes a padded back 92 which is secured to a rigid back frame 94. The back 92 has a flat surface to receive the back of a user of the bench. Forming part of the frame 94 are a pair of rigid plates 96 having arcuate edges. The plates 96 are located adjacent to the opposite sides 46 of the carriage body 44 and are rigidly connected with the structural members of the back frame 94. As best shown in FIGS. 3 and 4, a horizontal shaft 98 extends through the sleeve 60. The plates 96 are mounted to rotate on the horizontal axis provided by the shaft 98, thereby mounting the back 92 and its frame 94 for pivotal movement about the axis of the shaft 98.

The arcuate peripheral area of at least one of the plates 96 is provided with a plurality of spaced part openings 100 which are all located at the same distance from the pivot axis provided by shaft 98. The openings 100 are located such that the tip of the pin 86 enters an opening 100 that is aligned with the pin 86 when the pin is in its extended position. The entry of the pin 86 into the openings 100 provides a releaseable latch that can be used to latch the back 92 in a variety of different angular positions about the axis of the shaft 98, thereby allowing adjustment of the inclination of the back 92.

The bench 10 further includes a padded seat 102 which is secured to a rigid seat frame 104. The seat 102 has a flat surface to accommodate a user sitting on it with his or her back engaged with the flat surface of the back 92. The seat frame 104 includes a pair of rigid plates 106 which are secured to the structural members of the frame 104 and are located adjacent to and outwardly of the side plates 96 of the back frame 94. The plates 106 are mounted on the shaft 98 in a manner allowing the seat 102 and its seat frame 104 to pivot about the horizontal axis of the shaft 98. One of the plates 106 is provided with a sleeve 108 projecting from its outside surface. A horizontal pin 110 having a tee handle 112 on its outer end extends through the sleeve 108 and the side plate 106. A spring which is diagrammatically indicated at 114 in FIG. 3 acts against the pin 110 in a manner continuously urging the pin inwardly toward the position shown in FIG. 3. In this position, the tip of the pin 110 extends through one of a plurality of openings 116 formed through the adjacent side plate 96 of the back frame 94. The fit of the pin 110 in the opening 116 that is aligned with the pin serves as a releaseable fastening arrangement or latch that locks the seat 102 in a selected angular position relative to the back 92.

The openings 116 are arranged in an arcuate pattern centered on the axis of shaft 98 so that the pin 110 comes into alignment with the openings 116 as the seat 102 is pivoted relative to the back 92. The openings 116 may be arranged in any desired spacial pattern. However, in accordance with a preferred embodiment of the present invention, one of the openings 116 is located such that the seat 102 can be fastened or locked in a position wherein it forms a right angle with the back 92, as shown in FIG. 2. Also, another of the openings 116 is preferably located such that the pin 110 enters it when the back 92 is in the prone position shown in FIG. 1 and the seat 102 is likewise in the prone position of FIG. 1. Then, the surfaces of the seat 102 and back 92 are co-planar and provide a substantially continuous horizontal position on which a user can lie in a prone position.

The pin 110 can be withdrawn from opening 116 by pulling outwardly on the handle 112, thereby releasing the frame 104 of seat 102 and allowing the seat to be pivoted relative to the back 92.

In use, the carriage 42 can be positioned as desired along the length dimension of the base 11, with the fit of pin 70 in the aligned opening 40 serving to lock the carriage 44 in place. The back 92 and seat 102 can be adjusted to the desired angular positions. The back 92 is latched in place at the desired inclined position by the fit of pin 86 in the aligned opening 100. The seat 92 is latched or fastened in place at the desired or angular orientation relative to the back 92 by the fit of pin 100 in the aligned opening 116.

By way of example, the back 92 and seat 102 can be locked in the positions shown in solid lines in FIG. 2 wherein they form a right angle, with the back 92 at an inclination from vertical. If the user thereafter desires to change the inclination of the back 92, for example to a vertical orientation, he can operate the lever 82 in order to withdraw pin 86 from opening 100 so that the back 92 can be pivoted upwardly to a fully upright position. Because the seat 102 remains locked to the back 92 due to the fit of pin 110 in opening 116, the seat 102 pivots with the back 92 and the right angle orientation between the seat and back is maintained as the back is pivoted. The back 92 can be pivoted downwardly in a similar fashion, and the seat 102 pivots with the back to maintain its 90° orientation relative to the back.

However, if it is desired to pivot the seat 102 to a different angular orientation relative to the back 92, this can be accomplished by retracting the pin 110 from opening 116 and then pivoting the seat 102 as desired before releasing the pin 110 to enter whichever of the openings 116 is then in alignment with it. For example, the seat 102 can be pivoted independently of the back 92 to the broken line position of the seat shown in FIG. 2. Then, the seat is in a horizontal orientation while the back remains in an inclined orientation.

The exercise bench 10 readily accommodates a prone position of both the seat 102 and back 92. The back can be released by operating the lever 82 to the broken line position shown in FIG. 6 and then pivoting the back 92 downwardly until it is in the prone position shown in FIG. 1. The seat can be pivoted downwardly to the prone position shown in FIG. 1 by withdrawing pin 110 from opening 116 and then pivoting the seat downwardly before releasing the pin so that it then enters the opening 116 aligned with the pin. Both the seat 102 and the back 92 are thereafter latched in the prone positions of FIG. 1 so that the user can exercise while lying in a prone position on the seat and back.

The position of the bench along the length of the base 11 can be adjusted at any time by operating the lever 66 to the broken line position shown in FIG. 4. Then, the pin 70 is withdrawn from the openings 40 and the carriage 42 can be rolled along the rails 32 and 34 to the desired position. When the lever 66 is released, it returns to the solid line position and the pin 70 enters the aligned opening 40 to latch the carriage in place.

It is noteworthy that the linear adjustment of the bench is carried out without the need to move any of the components along the underlying support surface 18. The carriage 42 rolls along the base 11 and does not contact the surface 18 as it is being adjusted. Consequently, if the surface 18 is rough or uneven, no difficultly is encountered in carrying out the linear adjustment, in contrast to equipment having telescoping frames, one of which must be moved along surface 18 in order to linearly adjust the bench position.

It is also noteworthy that all of the adjustments that are provided can be easily reached and carried out while the user remains in a sitting position on the seat 102. The linear adjustment of the carriage 42 is carried out using the handle 68 to manipulate lever 66, and the handle 68 is conveniently located a short distance below the seat 102. Similarly, the adjustment of the inclination of the back 92 is carried out by pulling the handle 84 in order to manipulate lever 82. The handle 84 is located near the back edge of the carriage 42 where it can easily be reached by a user sitting on the seat 102. The handle 84 may be located on either side of the unit. The handle 112 of pin 110 which is used for angular adjustment of the seat 102 is similarly located close to the seat 102 where it is readily accessible to a user sitting on the seat.

If the bench 10 is to be used in exercises which require it to be moved from one exercise station to another, it can be easily moved by lifting on the handles 32 to lift the back end of the frame so that the wheels 16 are the only part of the frame in contact with the surface 18. If the bench 10 is used in weight training exercise, it can be moved in this fashion between different weight racks and positioned correctly for each rack through proper linear adjustment of the carriage 42.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An exercise bench comprising:

a base adapted to rest on a support surface;

a carriage mounted for linear movement along said base at a height above the support surface;

a releaseable lock for locking said carriage in a plurality of positions along said base;

a seat on said carriage pivotal about a substantially horizontal pivot axis;

a releaseable latch for latching said seat in a plurality of different pivotal positions relative to said carriage;

a bench back on said carriage mounted for pivotal movement thereon about a substantially horizontal hinge axis, said bench back having an end in proximity to said seat; and a releaseable fastener for fastening said back to said carriage in a plurality of positions at which the back is inclined at different angles.

2. A bench as set forth in claim 1, including:

a wheel on said base for use in transporting said base along the support surface; and a handle on said base to facilitate pulling said base along the support surface on said wheel.

3. A bench as set forth in claim 1, including:

a rail on said base extending thereon in a lengthwise direction; and a plurality of rollers on said carriage riding on said rail to facilitate movement of the carriage along the base.

4. A bench as set forth in claim 1, wherein said lock, said latch and said fastener are all manually operable and all manually accessible to a user sitting on said seat.

5. A bench as set forth in claim 1, wherein:

said base includes plural rails extending thereon in a lengthwise direction; and said carriage includes rigid opposite side plates each carrying a plurality of rollers riding on said rails.

6. A bench as set forth in claim 5, wherein said rollers include upper rollers riding generally along top surfaces of said rails and lower rollers riding generally along bottom surfaces of said rails.

7. A bench as set forth in claim 6, wherein:

said carriage includes a rigid top plate connecting said side plates;

said rails include a pair of rails spaced apart generally side by side and parallel;

said upper rollers include a pair of rollers on one of said rails and another pair of rollers on the other of said rails.

8. A bench as set forth in claim 1, including:

a rigid back frame secured to said back and mounted to said base for movement about said hinge axis; and a rigid seat frame secured to said seat and mounted to said base for movement about said pivot axis, said hinge and pivot axes being coaxial and said latch being operable to latch said seat frame to said back frame for pivotal movement therewith.

9. A bench as set forth in claim 8, wherein:

one of said positions of said back situates said back in a substantially horizontal position; and said latch is operable to latch said seat frame to said back frame in a manner to latch said seat in a substantially prone position when said back is in said substantially horizontal position.

10. In an exercise bench having a base for resting on a support surface, a seat pivotally mounted on the base, a bench back pivotally mounted on the base, and a mechanism allowing the seat and back to move linearly along the base, the improvement comprising:

a releaseable lock for said mechanism operable manually to lock the seat and back against linear movement on the frame away from a selected position;

a releaseable latch operable manually to latch said seat against pivotal movement; and a releaseable fastener operable manually to fasten said back against pivotal movement;

wherein said lock, said latch and said fastener are manually accessible to a user of the bench sitting on said seat.

11. An improvement as set forth in claim 10, wherein said mechanism comprises a carriage on which said seat and back are pivotally mounted, said carriage being adjustable on said base in a lengthwise direction thereon.

12. An improvement as set forth in claim 11, including a plurality of rollers allowing rolling movement of said carriage on said base.

13. An improvement as set forth in claim 10, wherein said latch is arranged to latch said seat to said back for pivotal movement therewith.

14. An improvement as set forth in claim 13, wherein said latch is arranged to latch said seat to said back in a plurality of different positions at which the relative angularity between the seat and back differs, said different positions including a position wherein said seat and back are oriented at substantially a right angle to one another and another position wherein said seat and back are both in substantially prone positions.

15. An improvement as set forth in claim 11, wherein said lock comprises a lock pin on said carriage operable to lock to said base.

16. An improvement as set forth in claim 11, wherein said fastener comprises a fastening pin on said back operable to fasten to said carriage.

17. An exercise bench comprising:

a rigid base adapted to rest on a support surface, said base having a length dimension;

a carriage mounted on said base for adjustment along said length dimension thereof;

a releaseable lock operable to lock said carriage to said base;

a bench back having a rigid back frame mounted to said carriage for movement about a substantially horizontal hinge axis to situate said back in a plurality of different inclined positions including a substantially horizontal position;

a releaseable fastener operable to fasten said back frame to said carriage in said different inclined positions of said back;

a bench seat having a rigid seat frame mounted for pivotal movement relative to said back frame about a substantially horizontal pivot axis; and a releaseable latch operable to latch said seat frame to said back frame for movement therewith in a position wherein said seat is at substantially a right angle to said back, said latch being releaseable to allow said seat to pivot to a substantially prone position when said back is in said substantially horizontal position thereof and being operable then to latch said seat frame to said back frame in said substantially prone position of said seat.

18. A bench as set forth in claim 17, wherein said latch includes a latch pin on said seat frame operable to releaseably latch to said back frame.

19. A bench as set forth in claim 18, wherein said fastener includes a fastening pin on said back frame operable to releaseably fasten to said carriage.

20. A bench as set forth in claim 19, wherein said lock pin includes a lock pin on said carriage operable to releaseably lock to said base.

* * * * *